United States Patent [19]

Tidwell

[11] 3,976,058

[45] Aug. 24, 1976

[54] PHYSICAL COORDINATION TRAINING DEVICE

[76] Inventor: James H. Tidwell, 116 W. Hopkins St., San Marcos, Tex. 78666

[22] Filed: Sept. 12, 1975

[21] Appl. No.: 612,703

[52] U.S. Cl. ..... 128/25 R; 35/29 R; 272/71; 272/93; 272/134; 272/144

[51] Int. Cl.[2] ..... A61H 1/02; A63B 31/00

[58] Field of Search ..... 272/134, 144, 136, 71, 272/93, 116, 135, 138; 128/25 R; 35/29 R, 29 B

[56] References Cited

UNITED STATES PATENTS

| | | | |
|---|---|---|---|
| 1,176,365 | 3/1916 | Hartnett | 272/71 |
| 2,397,054 | 3/1946 | Segalla | 272/134 |
| 3,362,090 | 1/1968 | Adam | 128/25 R X |
| 3,589,720 | 6/1971 | Agamian | 272/134 |
| 3,596,654 | 8/1971 | Tamura | 128/25 R |
| 3,754,547 | 8/1973 | Walker | 125/25 R |

FOREIGN PATENTS OR APPLICATIONS

| | | | |
|---|---|---|---|
| 824,654 | 11/1937 | France | 272/144 |

*Primary Examiner*—Jerome Schnall

[57] ABSTRACT

A device for teaching different basic skills of physical coordination, particularly of locomotion, including a frame supported above a floor, right and left hand levers and right and left foot levers pivotally connected to the frame, right and left connecting links pivotally connected between the right hand and right foot levers and between the left hand and left foot levers respectively, and a motion transfer bar for transferring motion between the hand and foot levers on one side of the device and the hand and foot levers on the other side of the device. The device may be altered for different types of physical coordination by shifting the pivot axis of connection of the connecting links with the hand levers relative to the pivot axis of the hand levers with the frame, and by shifting the pivot axis of connection of the transfer bar with the hand lever to which it is connected relative to the pivot axis of the hand lever to the frame.

8 Claims, 8 Drawing Figures

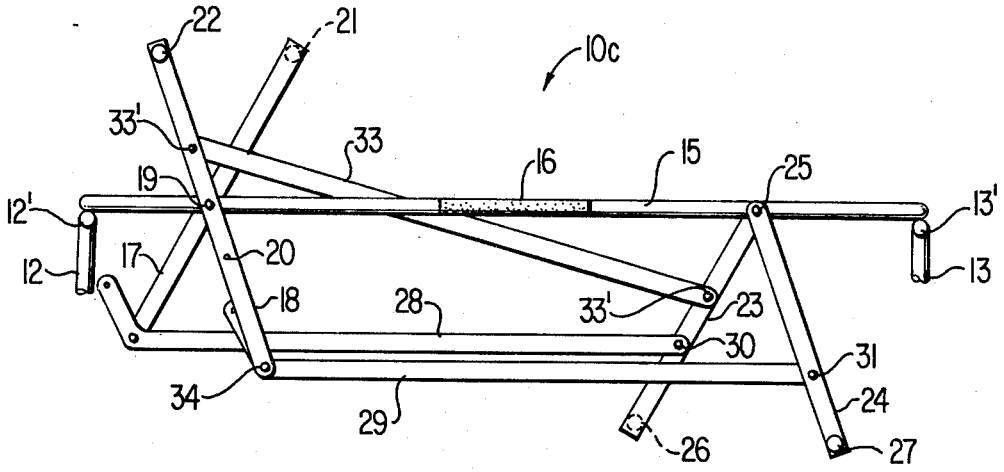
FIG. 4
FIG. 5
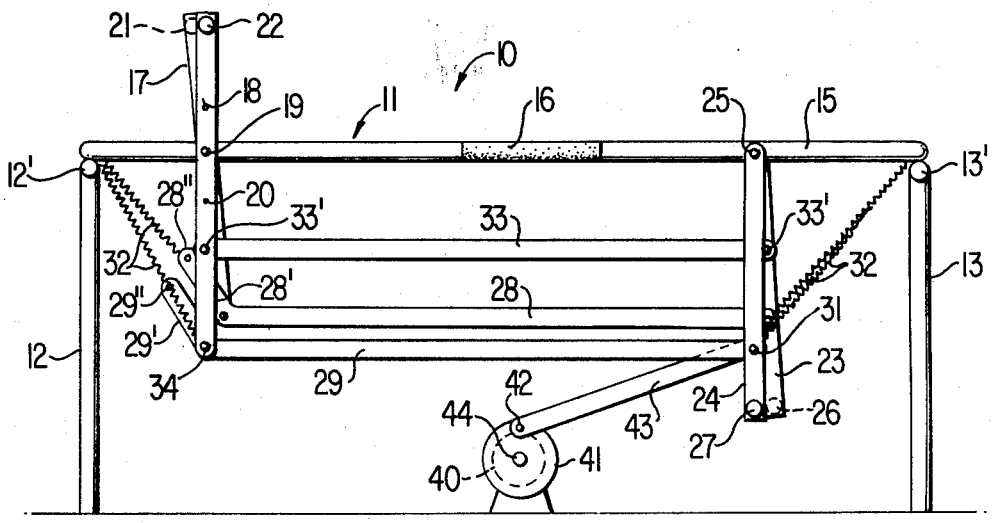

PHYSICAL COORDINATION TRAINING DEVICE

This invention relates to a physical coordination training device and particularly relates to apparatus for teaching young children and physically disabled persons (i.e. Mongoloids, cerebral palsied, etc.) better gross muscle control and body coordination.

There are three basic motions an infant and young person must thoroughly master in order to be adept at more advanced physical activities. It is believed that if a young person does not master these three basic movements, they will be poor performers in running, catching a ball, etc., and possibly even poor readers.

This instrument is designed to teach these three basic skills. The first movement is a flexing action by which both arms thrust forward and both legs thrust back. Then the arms are pulled back to the chest, the legs pulled back to the body and the extension action repeated.

The second motion is a type of crawling motion in which the left arm and left leg are moved forward, then the right arm and right leg are brought forward. Then the same motions are repeated in sequence indefinitely.

The third motion is a crawling movement with a cross-over action. The right are and left leg move forward, then the left arm and right leg move forward and the same motions are repeated in sequence. The same motion is used in walking, running, etc.

This invention is capable of providing training in all three of the above described basic skills merely by readjusting the position of certain parts of the apparatus in the manner subsequently to be described.

It is an object of this invention to provide a single apparatus for providing training in a plurality of the basic physical skills of human individuals.

It is another object of this invention to provide physical training apparatus including a substantially horizontal elongated frame having means for supporting the frame above a floor, right and left hand levers, and right and left foot levers pivotally connected to the frame, right and left connecting links pivotally connected between the right hand and right foot levers, and between the left hand and left foot levers respectively, and a motion transfer bar for transferring motion between the hand and foot levers on one side of the device and the hand and foot levers on the other side of the device.

BRIEF DESCRIPTION OF THE DRAWING

With the foregoing more important objects and features in view and such other objects and features which may become apparent as this specification proceeds, the invention will be understood from the following description taken in conjunction with the accompanying drawings, in which like characters of reference are used to designate like parts, and in which:

FIG. 4 is a partial side elevational view of the invention with parts arranged for physical training in a third skill;

FIG. 5 is a side elevational view of the invention as shown in FIG. 2 with the addition of an electric motor for driving the physical training device;

DETAILED DESCRIPTION OF THE INVENTION

Figure 1:
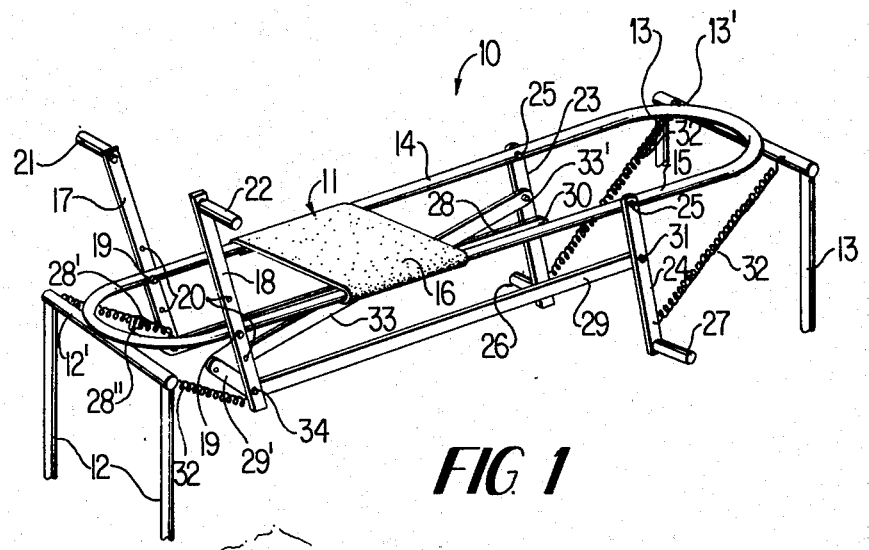
FIG. 1 is a perspective view of the invention with parts arranged for physical training in a first skill.
Figure 2:
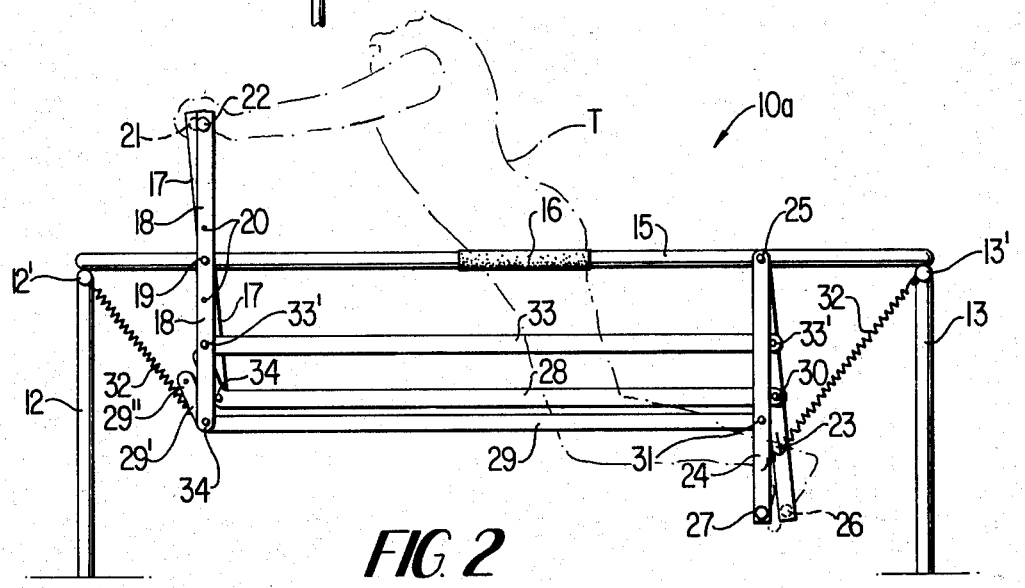
FIG. 2 is a side elevational view of the invention as shown in FIG. 1.

The physical training device 10 of this invention is shown in FIG. 1 as comprising an elongated frame 11 having opposite pairs of front and back legs 12 and 13. The frame 11 preferably includes transverse end member 12', and 13', and transversely spaced parallel side rails 14 and 15 between which a body rest 16 is mounted. Right and left hand levers 17 and 18 are pivotally mounted on the side rails 14 and 15 respectively at a position forward of the body rest 16 by pivot bolts 19 which extend through a selected one of plural holes 20 spaced longitudinally along the length of the hand levers and through holes (not shown) in the side rails 14 and 15 to which the respective hand levers are attached. Handle bars 21 and 22, attached at the top of the respective hand levers 17 and 18, extend laterally outwardly therefrom. Right and left foot levers 23 and 24 are pivotally supported at their upper ends rearwardly of the body support 16 from the side rails 14 and 15 respectively by pivot bolts 25. Foot bars 26 and 27 are secured to the bottom ends of the foot levers 23 and 24 and extend laterally outwardly therefrom. A right connecting link 28 interconnects the right hand lever 17 and right foot lever 23; a left connecting link 29 interconnects the left hand lever 18 and left foot lever 24. The rear ends of the links 28 and 29 are pivotally connected to the foot levers 23 and 24 respectively at points intermediate the ends of the foot levers by pivot pins 30 and 31 respectively. The front ends of the links 28 and 29 are pivotally connected at selected points along the length of the hand levers 17 and 18 respectively by bolts 34 passed through holes at the forward ends of the links and selected ones of the longitudinally spaced holes 20 provided in the hand levers 17 and 18. The links 28 and 29 have forward extensions 28' and 29' respectively each provided with a transverse hole therein. The extensions 28' and 29' angle upwardly from the main body portion of the links 28 and 29. Suitable resilient tension means 32, such as coil springs 32 as shown, rubber bands or the like are interconnected between the end members 12' and 13' and the hand levers 17, 18 and foot levers 24, 25 respectively to offer resistance to movement of the hand and foot levers for the purpose of strengthening the muscles of the person using the invention. A motion transfer bar 33 having transverse holes at opposite ends, pivotally interconnects the right foot lever 23 and left hand lever 18 so as to transfer motion from the right hand side to the left hand side of the device as will be subsequently described. The connections of the forward ends of the connecting links 28 and 29 and transfer bar 33 to the hand levers 17 and 18 may be selectively raised or lowered inorder to promote specific physical training skills. The invention with parts arranged as in FIGS. 1 and 2 is designed to promote the physical skill illustrated in FIG. 6. It will be noted that in this arrangement of the invention the connecting link 28 is attached to the right foot lever 23 and to the lower end of the right hand lever 17 in substantially parallel relationship with the side rail 14; the connecting link 29 is attached to the left foot lever 24 and to the lower end of the left hand lever 18 in substantially parallel relationship with the side rail 15, and the transfer bar 33 is attached to the inside of the right foot lever and the lower end of the left hand lever.

Figure 6:
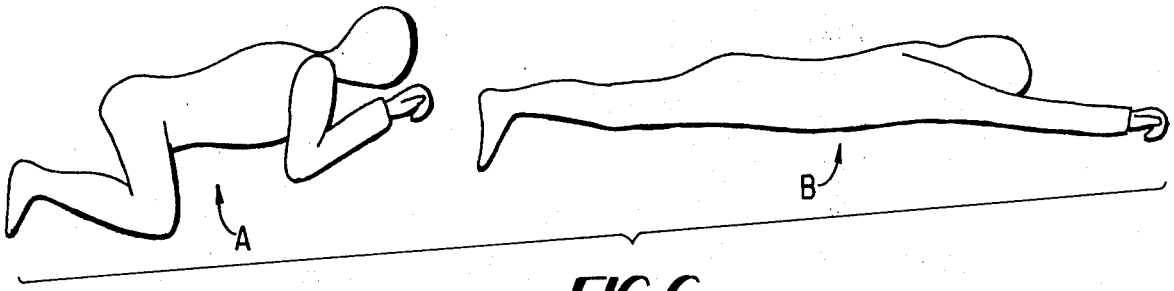
FIG. 6 is a diagramatic view of a first physical skill which is developed in a human being by the invention with its parts arranged as shown in FIG. 1.

The skill illustrated diagrammatically in FIG. 6 is the first movement described earlier in this specification. The skill requires a retraction motion of the person undergoing training, wherein the person folds the arms back to the chest and the legs to the body, and then an extension motion wherein the arms and legs are fully extended. In using the training device 10 as illustrated in FIGS. 1 and 2 to practice the skill illustrated in FIG. 6, the trainee T rests on the body rest 16 astride the side rails 14 and 15 facing forward toward the hand levers 17 and 18. The trainee then leans forward, grasps the handles 21 and 22 in the right and left hand and extends the right and left feet into contact with the foot pedals 26 and 27 respectively. The trainee then begins the training exercise illustrated in FIG. 6 by pulling back on the handles 21 and 22 so that the trainee's arms are drawn toward the chest. In doing so the hand levers 17 and 18 are rotated clockwise about pivot bolts 19,19 moving the lower ends thereof forward; the links 28 and 29, attached to the lower ends of the hand levers 17 and 18, move forward and pull the foot levers 23 and 24 forward rotating them clockwise about pivots 25, 25. The forward motion of the foot levers forces the trainee's legs to fold toward the body as seen at A in FIG. 6. The transfer bar 33 connected by pivot bolts 33' between the right foot lever 23 and the left hand lever 18 below the pivots 25 and 19 respectively causes similar and simultaneous motion of the hand and foot levers on the right and left sides of the device 10. After the trainee performs the retraction motion A as just described, he begins the extension motion illustrated at B in FIG. 6 by pushing the handles 21 and 22 forward and by pushing the foot levers 23 and 24 rearward. The forward motion of the trainee's arms and the rearward motion of the trainee's legs is automatically coordinated through the connecting links 28 and 29 and the transfer bar 33 previously described.

Figure 3:
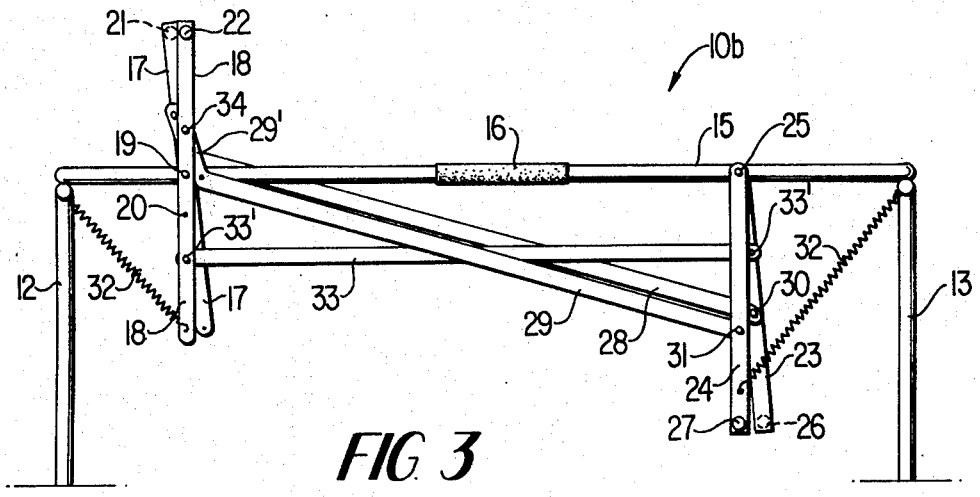
FIG. 3 is a side elevational view of the invention with parts arranged for physical training in a second skill.
Figure 7:
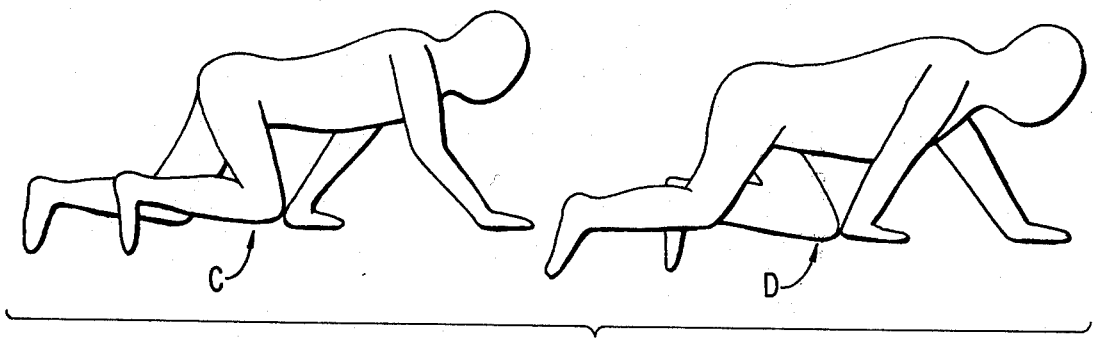
FIG. 7 is a diagramatic view of a second physical skill which is developed in a human being by the invention with its parts arranged as shown in FIG. 3.

FIG. 3 shows a modified form 10*a* of the invention including all of the same parts described with reference to FIGS. 1 and 2 but with the links 28 and 29, rearranged inorder to develope the physical skill illustrated in FIG. 7. As shown in FIG. 3 the front ends of the links 28 and 29 have been disconnected from the lower ends of the hand levers 17 and 18 and have been moved up above the hand lever pivots 19,19 and reattached to the hand levers by inserting the bolts 34 through the holes 28'' and 29'' at the ends of the offsets 28' and 29' respectively and through the uppermost of the holes 20 in the hand levers 17 and 18. With the links so arranged circular motion of the hand levers 17 and 18 in one direction produces circular motion of the foot levers 23 and 24 in the opposite direction.

In using the apparatus 10*a* the trainee straddles the side rails 14 and 15 in the area over the body rest 16, with hands on the handle bars 21 and 22 and with feet on the foot bars 26 and 27. The trainee then pushes forward on the right handle bar 21 causing the right hand lever to rotate counterclockwise and the right foot lever to rotate clockwise moving the trainee's right leg forward. The motion transfer bar 33, which is connected between the right foot lever 23 and left hand lever 18 in the same manner as shown in FIGS. 1 and 2, moves the left hand lever clockwise. Clockwise motion of the left hand lever moves the left hand link 29 rearward, and the rearward motion of the link 29 rotates the left foot lever counterclockwise. Thus the apparatus 10*a* coordinates the movements of the trainee so that the forward extension of the right arm assures forward folding of the right leg, accompanied by retraction of the left arm and rearward extension of the left leg as shown at C in FIG. 7. Rearward retraction of the right arm causes rearward extension of the right leg, accompanied by forward extension of the left arm and forward folding of the left leg, as shown in D in FIG. 7.

Figure 8:
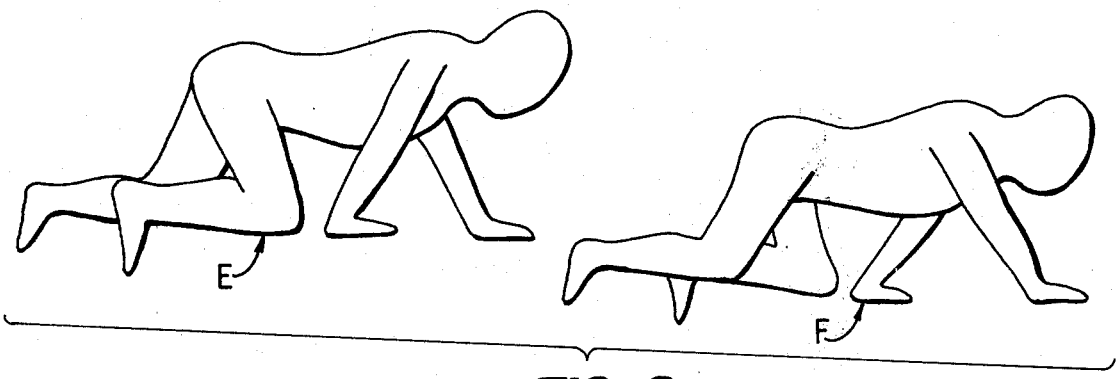
FIG. 8 is a diagramatic view of a third physical skill which is developed in a human being by the invention with its parts arranged as shown in FIG. 4.

FIG. 4 shows a modified form 10*b* including all of the same parts described with reference to FIGS. 1 and 2, but with the transfer bar 33 rearranged inorder to develope the skill illustrated in FIG. 8. As shown in FIG. 4, the front end of the motion transfer bar 33 has been shifted from its position below the left hand lever pivot 19 to a position above the pivot 19. The links 28 and 29 are connected in the same way as was described with respect to FIGS. 1 and 2. The motion bar 33 connected as shown in FIG. 4 transfers a circular motion in one direction by the right foot lever 23 to a circular motion in the opposite direction by the left hand lever 18.

On using the apparatus 10*b* the trainee sits on the body rest 16 astride the side rails 14 and 15 with hands and feet engaging the handle bars 21,22 and foot bars 26,27 respectively. A retraction of the right arm toward the chest rotates the right hand lever 17 clockwise and moves the link 28 forward, forward motion of link 28 rotates the right foot lever 23 clockwise so as to fold the right leg forward toward the body. Clockwise motion of the right foot lever 23 causes counter-clockwise motion of the left hand lever 18 through the motion transfer bar 33. The left arm is thus extended forward and the left leg is extended rearward through the action of the link 29 on the left foot lever 24. This position is shown at E in FIG. 8. The trainee then moves the right arm forward rotating the right hand lever 17 counter-clockwise. The link 28 moves rearwardly and rotates the right foot lever 23 counter-clockwise extending the right leg rearwardly. The counter-clockwise motion of the right foot lever 23 moves the left hand lever 18 clockwise by action of the motion transfer bar 33 and shifts the trainee's left arm rearwardly. Clockwise motion of the left hand lever is transferred to the left foot lever 24 through the left link 29 shifting the trainee's left leg forward. The latter motion of the trainee is shown at F in FIG. 8.

FIG. 5 shows the device 10 as shown in FIGS. 1 and 2 but with an electric motor 40 provided to drive the device. In the case of severely handicapped persons who do not have sufficient muscle control to operate the training device 10 by themselves a motor driven device may be required to develope muscle control and coordination in the person. As shown in FIG. 5 a disc 41 is secured to the shaft 44 of a variable speed electric motor 41 and a link 43 is pivotally connected between an eccentric 42 on the disc 41 and the foot lever 24. Rotation of the motor shaft 44 rotates the disc 41 and the eccentric 42 causing the link 43 to oscillate which in turn oscillates the foot lever 24. Motion of the foot lever 24 is transferred to the left hand lever 18, and motion of lever 18 is transferred to the right foot lever 23 through the transfer bar 33.

It is within the scope of this invention that the training device 10 (including its rearranged forms 10*a*, and 10*b*) may be covered with fiberglass body that simulates a horse, car, etc. with only the handle bars 21 and 22 and foot pedals 26 and 27 exposed.

While in the foregoing there has been described and shown a preferred embodiment of the invention, various modifications and equivalents may be resorted to within the spirit of the invention as claimed.

What is claimed is:

1. A physical training device for teaching diverse basic skills of muscle control and body coordination, comprising an elongated frame supported above a floor, right hand and right foot levers pivotally supported in longitudinally spaced relationship on one side of the said frame, left hand and left foot levers pivotally supported on the opposite side of said frame, the right and left hand levers having pivot axes which are aligned transversely with respect to said frame, and the right and left hand foot levers having pivot axes which are likewise aligned transversely with respect to said frame, a body support on said frame at a location between the hand lever axes and the foot lever axes, a right link pivotally interconnecting said right hand and right foot levers, a left link pivotally interconnecting said left hand and left foot levers, and a motion transfer bar pivotally interconnecting the foot lever on one side of said frame with the hand lever on the opposite side of said frame, said right and left foot levers each having upper and lower ends, the pivot axis of each of said foot levers being located in the upper ends of the foot levers so that the foot levers depend downwardly from said frame, foot engaging means at the lower end of each of the foot levers, said hand levers each having upper and lower ends and having their pivot axis located intermediate their ends so that the opposite ends of the hand levers extend above and below their pivot axis, hand engaging means at the upper end of each of the hand levers, said right and left hand links and said motion transfer bar being adjustably connected along the length of the hand levers to which they are respectively connected so that they may be selectively positioned alternatively above and below the pivot axis of the hand levers to which they are connected.

2. The physical training device according to claim 1 wherein the right and left links and the motion transfer bar are all connected below the pivot axes of respective hand levers.

3. The physical training device according to claim 1 wherein the right and left links are connected above and the motion transfer bar is connected below the pivot axis of respective hand levers.

4. The physical training device according to claim 1 wherein the right and left links are connected below and the motion transfer bar is connected above the pivot axis of respective hand levers.

5. The physical training device according to claim 1 together with power means for oscillating said hand and foot levers.

6. The physical training device according to claim 1 together with resilient biasing means for biasing said hand and foot levers to a position of static equilibrium, said resilient biasing means offering increasing resistance to the motion of said hand and foot levers away from their position of static equilibrium.

7. The device according to claim 1 where said frame includes a pair of parallel transversely spaced side rails, said body support spanning said side rails intermediate the hand and foot levers, said left hand and left foot levers being pivotally supported from one of said side rails and said right hand and right foot levers being pivotally supported from the other of said side rails.

8. The device according to claim 7, wherein said frame further includes a pair of transverse end members for supporting opposite ends of said side rails, and legs depending from said end members for supporting said frame above a floor, or other support surface.

* * * * *